US009748687B2

(12) United States Patent
Yokoyama

(10) Patent No.: US 9,748,687 B2
(45) Date of Patent: Aug. 29, 2017

(54) SHIELDING CONNECTOR

(71) Applicant: Japan Aviation Electronics Industry, Limited, Tokyo (JP)

(72) Inventor: Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/308,912

(22) PCT Filed: May 15, 2015

(86) PCT No.: PCT/JP2015/064087
§ 371 (c)(1),
(2) Date: Nov. 4, 2016

(87) PCT Pub. No.: WO2015/186494
PCT Pub. Date: Dec. 10, 2015

(65) Prior Publication Data

US 2017/0093076 A1 Mar. 30, 2017

(30) Foreign Application Priority Data

Jun. 3, 2014 (JP) ..... 2014-115217

(51) Int. Cl.
*H01R 29/00* (2006.01)
*H01R 13/502* (2006.01)
(Continued)

(52) U.S. Cl.
CPC ..... *H01R 13/502* (2013.01); *H01R 4/02* (2013.01); *H01R 24/60* (2013.01); *H01R 2107/00* (2013.01)

(58) Field of Classification Search
CPC ... H01R 103/00; H01R 13/635; H01R 13/633
(Continued)

(56) References Cited

U.S. PATENT DOCUMENTS 5,934,942 A * 8/1999 Patel ..... H01R 13/6582 439/607.5
7,591,664 B2 * 9/2009 Nomiyama ..... H01R 13/6275 439/352
(Continued)

FOREIGN PATENT DOCUMENTS

JP H04-072465 U 6/1992
JP H11-260490 A 9/1999
(Continued)

OTHER PUBLICATIONS

International Search Report in PCT/JP2015/064087, dated Aug. 11, 2015.
(Continued)

*Primary Examiner* — Phuongchi T Nguyen
(74) *Attorney, Agent, or Firm* — Collard & Roe, P.C.

(57) ABSTRACT

A connector has a front shell and a back shell. The front shell is provided with a first contact portion and a fixed portion. The first contact portion surrounds a periphery of the fixed portion in a plane orthogonal to a predetermined direction. The back shell is provided with an opening portion and a second contact portion. The second contact portion surrounds a periphery of the opening portion in a plane orthogonal to the predetermined direction. The second contact portion is in contact with the first contact portion in the predetermined direction so that the fixed portion is visible within the opening portion in the predetermined direction and that the back shell is positioned with respect to the front shell. The fixed portion and the second contact portion are fixable to each other using a conductive fixing agent through the opening portion.

11 Claims, 12 Drawing Sheets

(51) Int. Cl.

| | |
|---|---|
| ***H01R 4/02*** | (2006.01) |
| ***H01R 24/60*** | (2011.01) |
| *H01R 107/00* | (2006.01) |

(58) Field of Classification Search
USPC ..... 439/188, 159, 160, 152–155
See application file for complete search history.

(56) References Cited

U.S. PATENT DOCUMENTS

| | | | | |
|---|---|---|---|---|
| 8,303,343 | B2 * | 11/2012 | Nagata ..... | H01R 13/6461 439/607.54 |
| 2013/0323970 | A1 | 12/2013 | Wang et al. | |

FOREIGN PATENT DOCUMENTS

| | | | |
|---|---|---|---|
| JP | 2009-123627 | A | 6/2009 |
| JP | 2011-124147 | A | 6/2011 |
| JP | 2013-004639 | A | 1/2013 |
| JP | 2013-182753 | A | 9/2013 |
| TW | M331728 | U | 5/2008 |
| TW | I371147 | B1 | 8/2012 |

OTHER PUBLICATIONS

Taiwanese Office Action dated Apr. 21, 2017 with English translation.

* cited by examiner

SHIELDING CONNECTOR

CROSS REFERENCE TO RELATED APPLICATIONS

This application is the National Stage of PCT/JP2015/064087 filed on May 15, 2015, which claims priority under 35 U.S.C. §119 of Japanese Application No. 2014-115217 filed on Jun. 3, 2014, the disclosure of which is incorporated by reference. The international application under PCT article 21(2) was not published in English.

TECHNICAL FIELD

This invention relates to a connector which has a shell and a shielding means located rearward of the shell.

BACKGROUND ART

As a connector of this type, there is a connector disclosed in Patent Document 1. Referring to FIGS. 19 and 20, the connector 900 of Patent Document 1 has a shell (front shell) 910 and a back shell 920 which is located rearward of the shell 910 to function as a shielding means. In particular, as shown in FIG. 20, a paddle card (relay board) 950 or the like is disposed in the back shell 920.

PRIOR ART DOCUMENTS

Patent Document(s)

Patent Document 1: JPA 2011-124147

SUMMARY OF INVENTION

Technical Problem in accordance with intended use or usage of the connector, elements accommodated in the back shell can be different. For example, there is a demand for a change of an external shape or size of the back shell in order to mount an integrated circuit (IC) on the paddle card. Taking a cost into consideration, it is desirable to deal with the demand by means of changing the back shell only. However, there is a problem that posture of the back shell becomes unstable when the back shell is changed only.

Therefore, the present invention aims at providing a connector having a simple structure capable of stabilizing posture of a back shell.

Solution to Problem

One aspect of the present invention provides a connector which is mateable with a mating connector in a front-rear direction. The connector comprises a front shell and a back shell. The back shell overlaps with the front shell in a predetermined direction orthogonal to the front-rear direction. The front shell is provided with a first contact portion and a fixed portion. The first contact portion surrounds a periphery of the fixed portion in a plane orthogonal to the predetermined direction. The back shell is provided with an opening portion and a second contact portion. The second contact portion surrounds a periphery of the opening portion in a plane orthogonal to the predetermined direction. The second contact portion is in contact with the first contact portion in the predetermined direction so that the fixed portion is visible within the opening portion in the predetermined direction and that the back shell is positioned with respect to the front shell. The fixed portion and the second contact portion are fixable to each other using a conductive fixing agent through the opening portion.

Advantageous Effects or Invention

According to the present invention, in a state where the second contact portion of the back shell is in contact with the first contact portion of the front shell, the fixed portion of the front shell and the second contact portion of the back shell can be fixed to each other using a conductive fixing agent such as solder through the opening portion of the back shell. Thus, the back shell and the front shell are fixed to each other after positioning of the back shell with respect to the front shell is performed using the back shell and the front shell. Accordingly, posture of the back shell becomes stable.

Positioning of the back shell with respect to the front shell is performed using the back shell and the front shell. Accordingly, the posture of the back shell can be stabilized without changing the structure of the holding portion or the like of the connector in accordance with the size and shape of the back shell.

An appreciation of the objectives of the present invention and a more complete understanding of its structure may be had by studying the following description of the preferred embodiment and by referring to the accompanying drawings.

DESCRIPTION OF EMBODIMENTS

Figure 1:
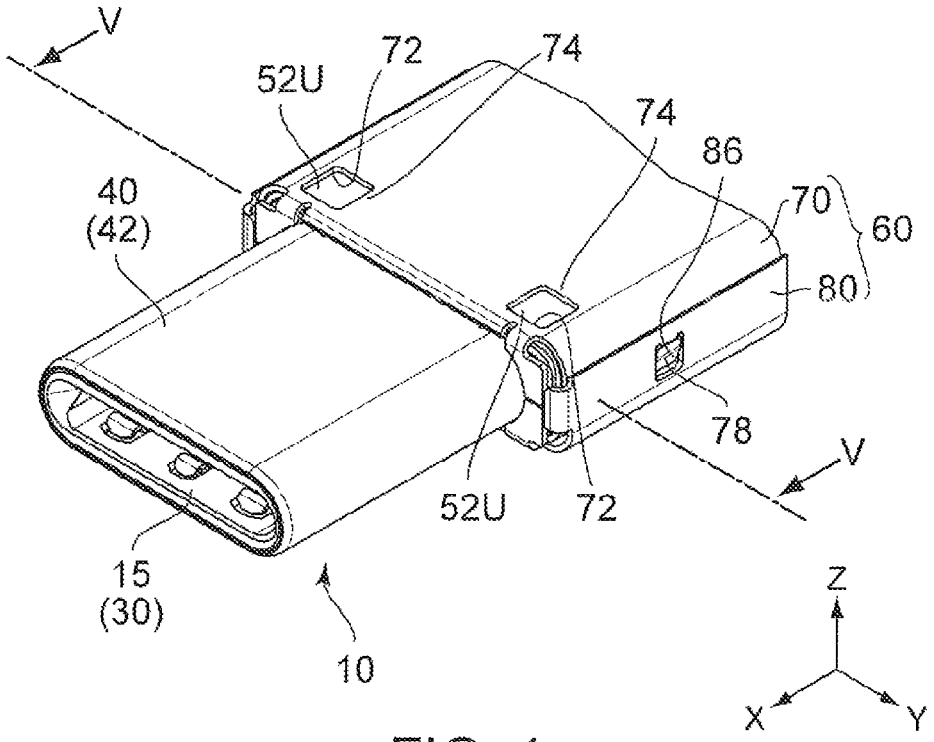
FIG. 1 is a top perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1 to 5, a connector 10 according to an embodiment of the present embodiment is to be mated with a mating connector (not shown) in a front-rear direction. The front-rear direction is shown as an X-direction in the drawings. Moreover, forward is a positive X-direction, and rearward is a negative X-direction. The connector 10 has a connector body 15, a front shell 40 and a back shell 60. The front shell 40 is also simply referred to as a shell. The front shell 40 covers the connector body 15 in part. The back shell 60 overlaps with the front shell 40 in a predetermined direction orthogonal to the front-rear direction. In the present embodiment, the predetermined direction is an up-down direction. The up-down direction is shown as a Z-direction in the drawings. Moreover, upward is a positive Z-direction, and downward is a negative Z-direction. As shown in FIGS. 8 to 12, to a rear side of the connector body 15, a paddle card (relay board) 100 is attached. As understood from FIGS. 1 to 4 and FIGS. 8 to 12, the back shell 60 is attached to the front shell 40 to cover the paddle card 100 when actually used.

Figure 3:
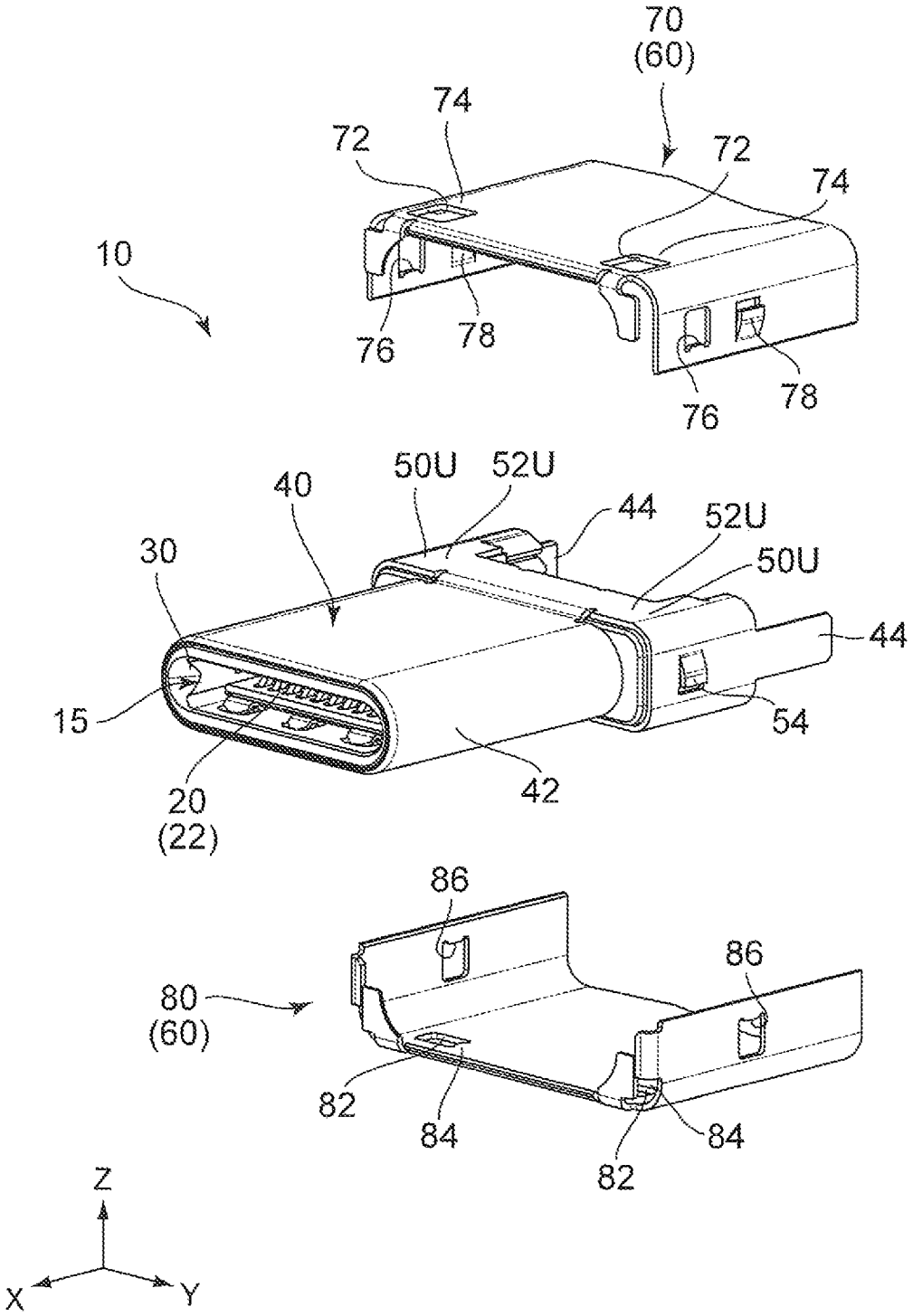
FIG. 3 is an exploded, top perspective view showing the connector of FIG. 1.
Figure 4:
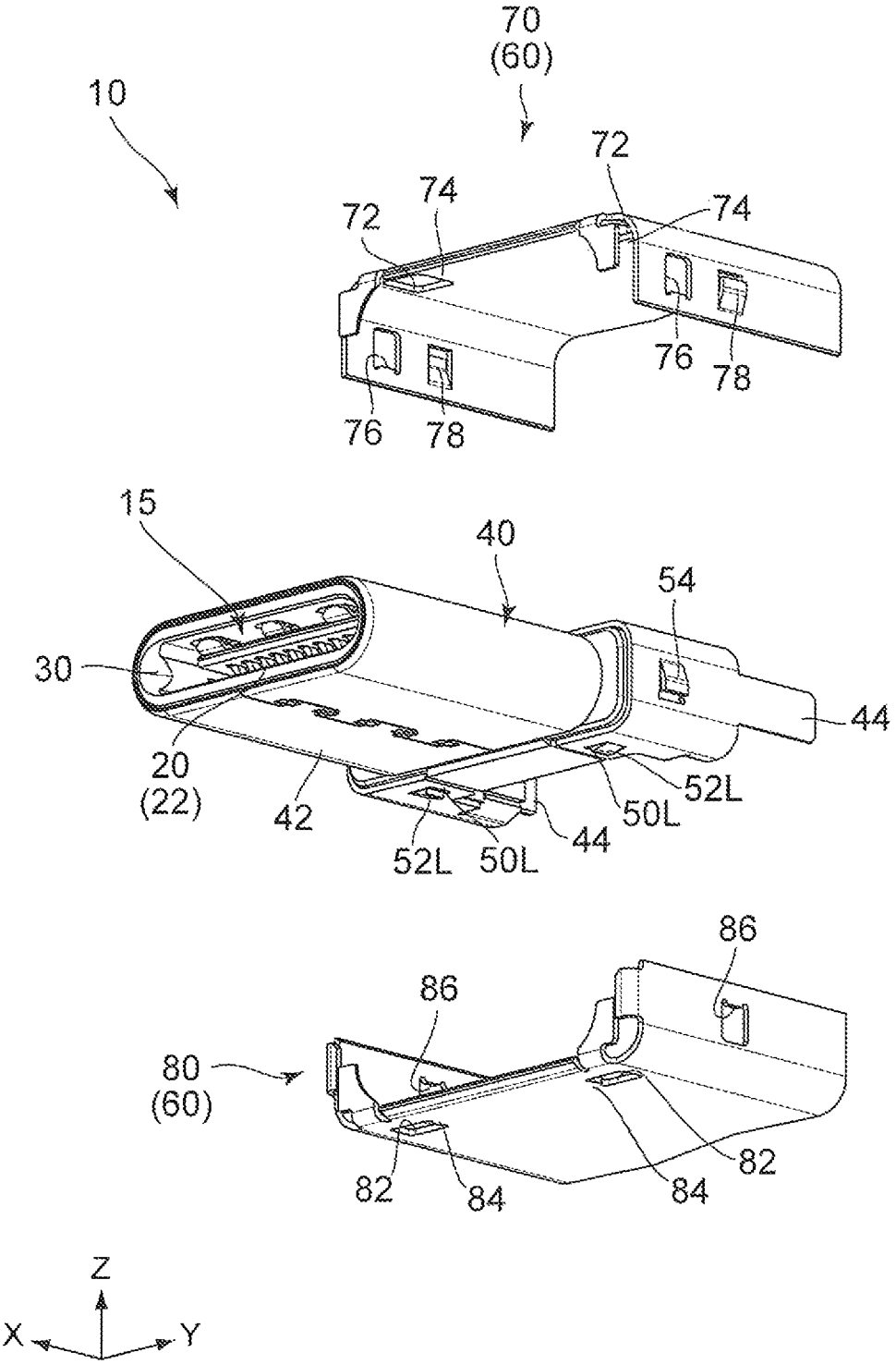
FIG. 4 is an exploded, bottom perspective view showing the connector of FIG. 2.
Figure 5:
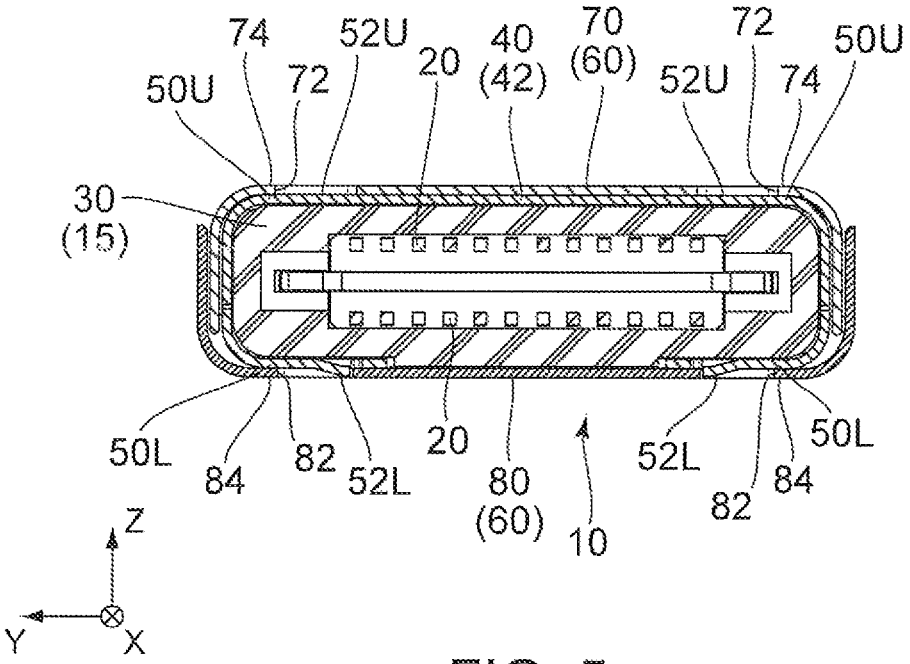
FIG. 5 is a cross-sectional view showing the connector of FIG. 1, taken along V-V line.

As shown in FIGS. 3 to 5, the connector body 15 has a plurality of contacts 20 and a holding portion 30 which is made of insulator and holds the contacts 20. As shown in FIGS. 3 and 4, each of the contacts 20 has a contact point portion 22 to be connected to a mating contact (not shown) of a mating connector (not shown). Furthermore, as shown in FIGS. 8 to 13, each of the contacts 20 has a connection portion 24 to be connected to the paddle card 100.

As shown in FIGS. 3 and 4, the front shell 40 has a main portion 42 and two protruding portions 44. The main portion 42 covers the connector body 15 in part. Each of the protruding portions 44 protrudes rearward from the main portion 42 in the front-rear direction.

The main portion 42 of the front shell 40 is provided with first contact portions 50U and 50L, fixed portions 52U and 52L and two side protruding portions 54. As shown in FIG. 3, the first contact portions 50U are two in number. Each of the first contact portions 50U is formed at an upper and rear region of the main portion 42. The fixed portions 52U are two in number. The fixed portions 52U are completely surrounded by the first contact portions 50U, respectively, in an orthogonal plane orthogonal to the predetermined direction. In the present embodiment, the orthogonal plane is an X-Y plane. In other words, the first contact portions 50U surround peripheries of the fixed portions 52U, respectively, in the orthogonal plane. In the present embodiment, there is no recognizable physical boundary between the first contact portions 50U and the fixed portions 52U. In other words, the first contact portions 50U and the fixed portions 52U of the present embodiment are formed as parts of one and the same plate-like portion. As shown in FIG. 4, the first contact portions 50L are two in number. Each of the first contact portions 50L is formed at a lower and rear region of the main portion 42. The fixed portions 52L are two in number. The fixed portions 52L are completely surrounded by the first contact portions 50L, respectively, in the orthogonal plane. In other words, the first contact portions 50L surround peripheries of the fixed portions 52L, respectively, in the orthogonal plane. In the present embodiment, the fixed portions 52L are more protrusive than the first contact portions 50L, in the predetermined direction. Specifically, the fixed portions 52L protrude downward of the first contact portions 50L. The side protruding portions 54 are individually formed by cutting and raising parts of the main portion 42, which are positioned at both side portions in a lateral direction. Each of the side protruding portions 54 protrudes outward in the lateral direction. In the drawings, the lateral direction is a Y-direction.

As understood from FIGS. 3 and 4, each of the protruding portions 44 has a flat-plate shape and is arranged to extend in a plane defined by the front-rear direction and an orthogonal direction orthogonal to the front-rear direction. In the present embodiment, the orthogonal direction is the up-down direction, i.e., the Z-direction. Moreover, the plane defined by the front-rear direction and the orthogonal direction is an X-Z plane. In the present embodiment, the predetermined direction and the orthogonal direction are identical with each other. However, the present invention is not limited thereto. The predetermined direction and the orthogonal direction may be different from each other. As understood from FIGS. 9 to 12, each of the protruding portions 44 has a size larger than a thickness of the paddle card 100 in the orthogonal direction (a size of the paddle card 100 in the Z-direction). Especially, in the present embodiment, each of the protruding portions 44 protrudes out from both outsides (namely, outward in the up-down direction) of the paddle card 100 in the orthogonal direction.

As understood from FIGS. 1 to 4, the back shell 60 according to the present embodiment consists of two members of an upper member 70 and a lower member 80.

As shown in FIGS. 1 and 3, the upper member 70 is provided with two opening portions 72, two second contact portions 74, two side opening portions 76 and two side protruding portions 78. The second contact portions 74 surround peripheries of the opening portions 72 in the orthogonal plane. That is, the opening portions 72 are completely surrounded by the second contact portions 74, respectively, in the orthogonal plane. Each of side portions of the upper member 70 is formed with one pair of the side opening portion 76 and the side protruding portion 78. The side opening portion 76 penetrates the upper member 70 in the lateral direction. The side protruding portion 78 is formed by cutting and raising the side portion of the upper member 70. The side protruding portion 78 is located rearward of and apart from the side opening portion 76 corresponding thereto in the front-rear direction and protrudes outward in the lateral direction.

Figure 2:
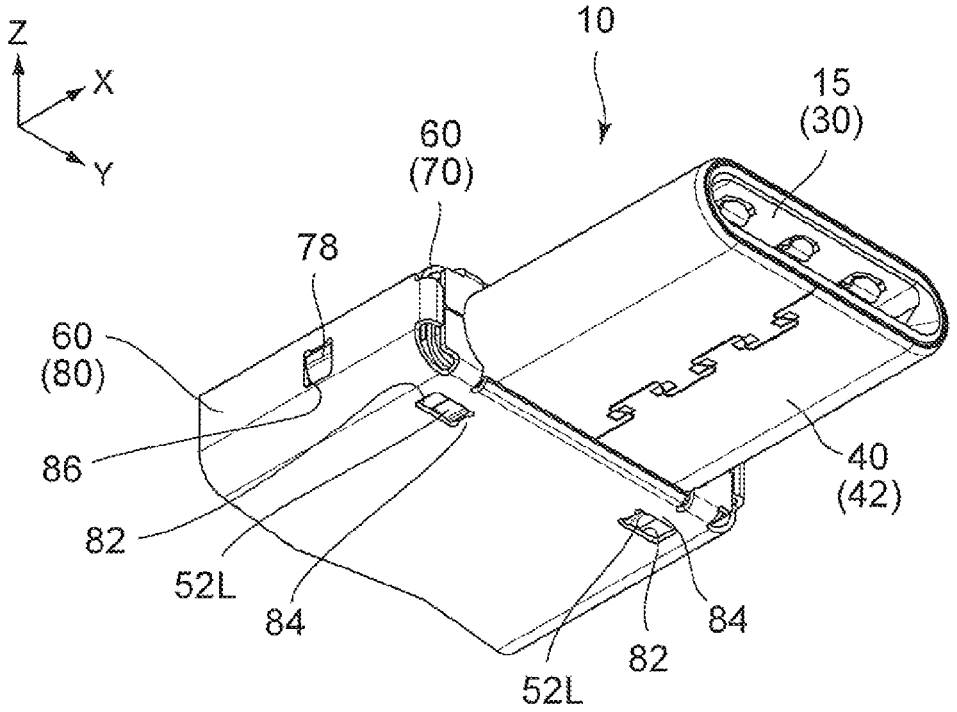
FIG. 2 is a bottom perspective view showing the connector of FIG. 1.

As shown in FIGS. 2 and 4, the lower member 80 is provided with two opening portions 82, two second contact portions 84 and two side opening portions 86. The second contact portions 84 surround peripheries of the opening portions 82 in the orthogonal plane. That is, the opening portions 82 are completely surrounded by the second contact portions 84 in the orthogonal plane. The side opening portions 86 penetrate side portions of the lower member 80 in the lateral direction, respectively.

As shown in FIGS. 8 to 12, the paddle card 100 protrudes rearward from the main portion 42 of the front shell 40 in the front-rear direction.

Figure 6:
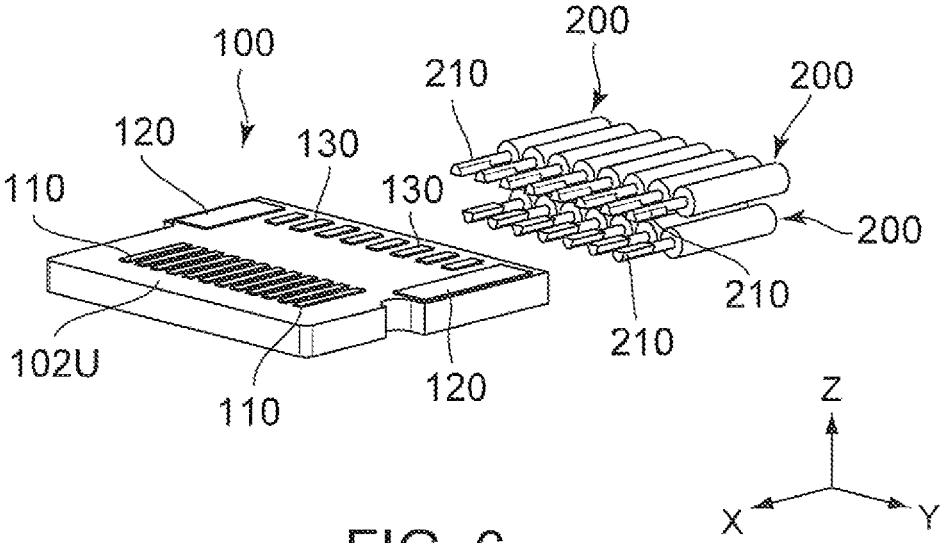
FIG. 6 is a top perspective view showing a paddle card and cables.
Figure 7:
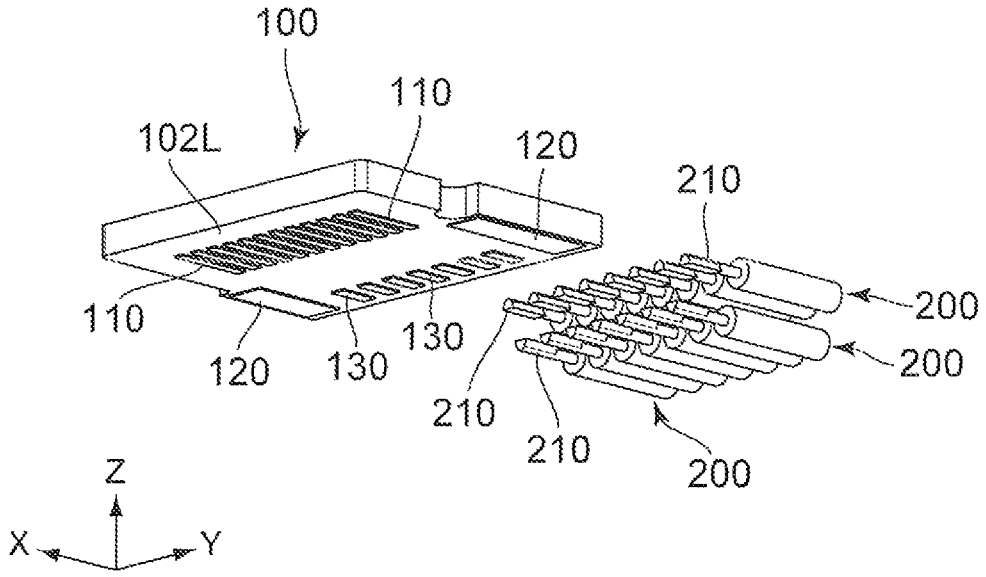
FIG. 7 is a bottom perspective view showing the paddle card and the cables of FIG. 6.
Figure 8:
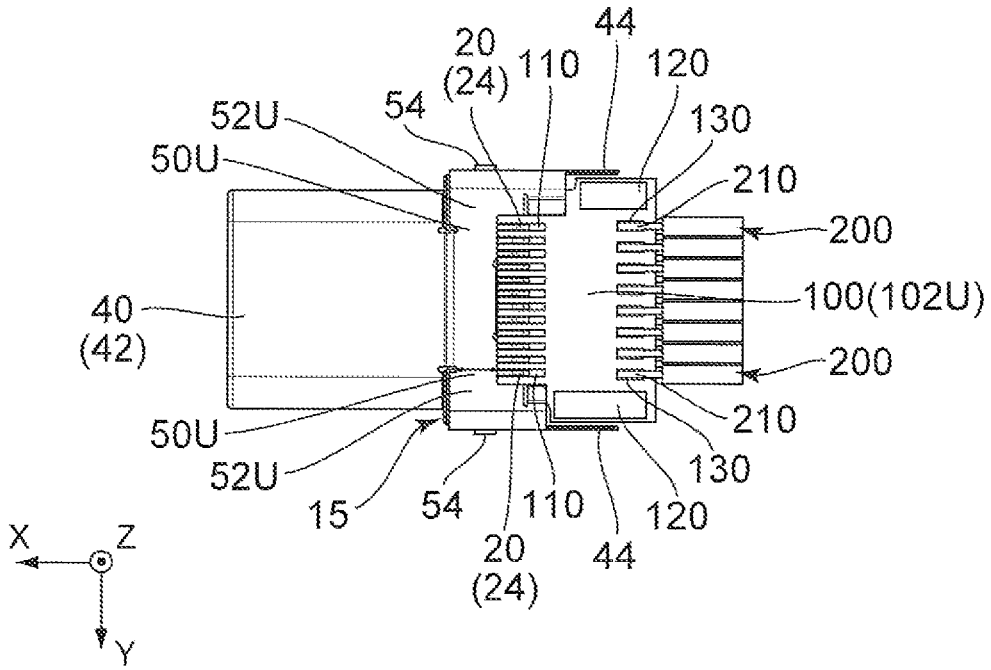
FIG. 8 is a top view showing a structural body having a connector body and a front shell of FIG. 3 and the paddle card and the cables of FIG. 6.
Figure 9:
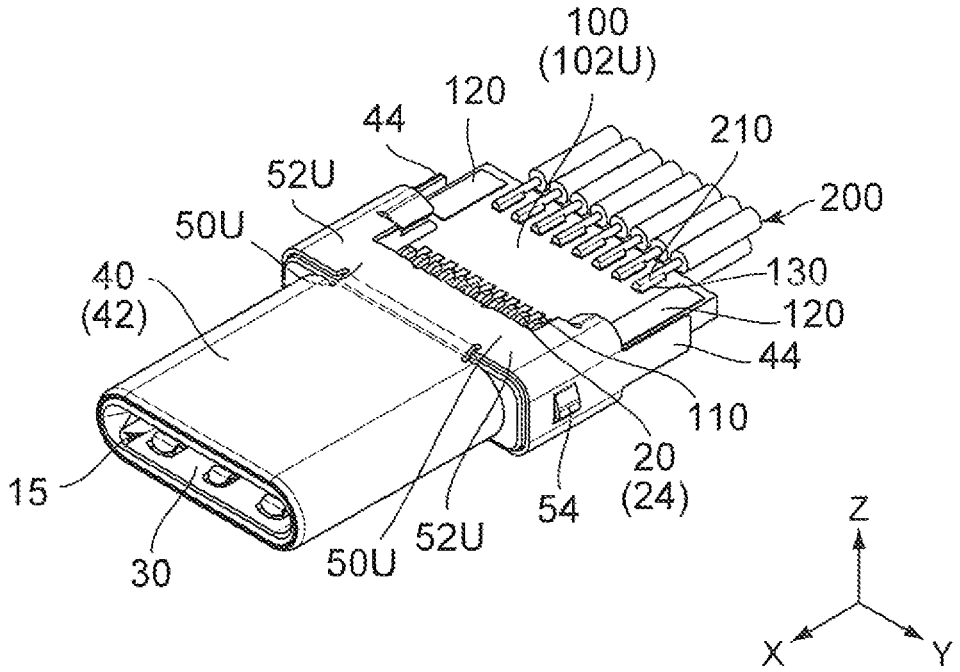
FIG. 9 is a front, top perspective view showing the structural body of FIG. 8.
Figure 10:
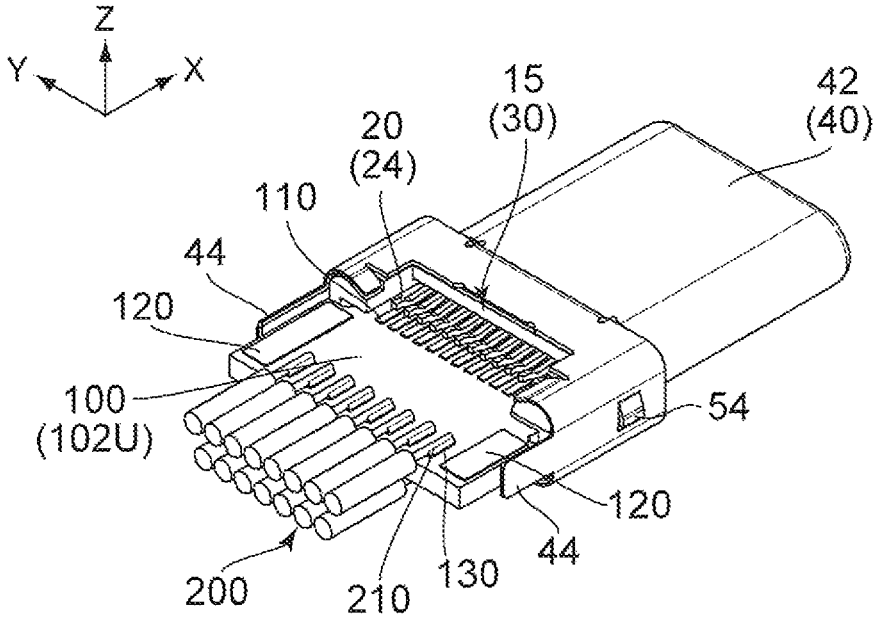
FIG. 10 is a rear, top perspective view showing the structural body of FIG. 8.
Figure 11:
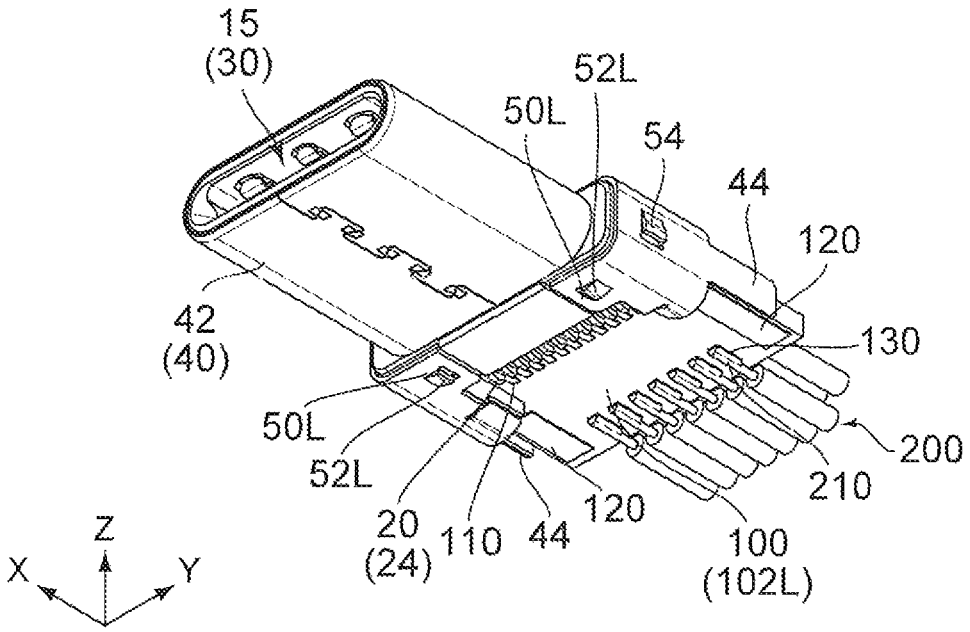
FIG. 11 is a front, bottom perspective view showing the structural body of FIG. 8.
Figure 12:
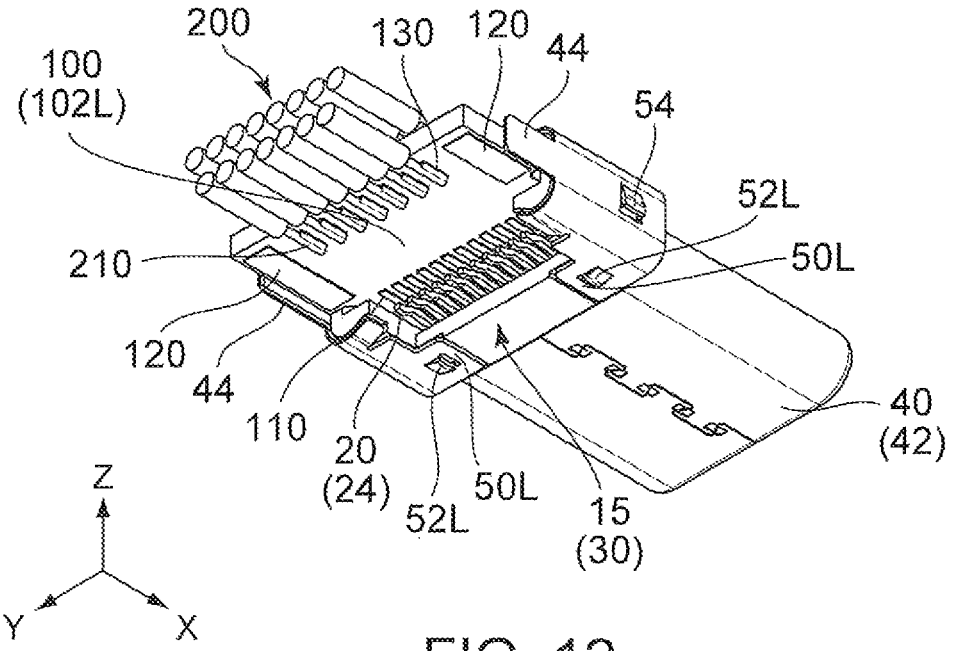
FIG. 12 is a rear, bottom perspective view showing the structural body of FIG. 8.
Figure 13:
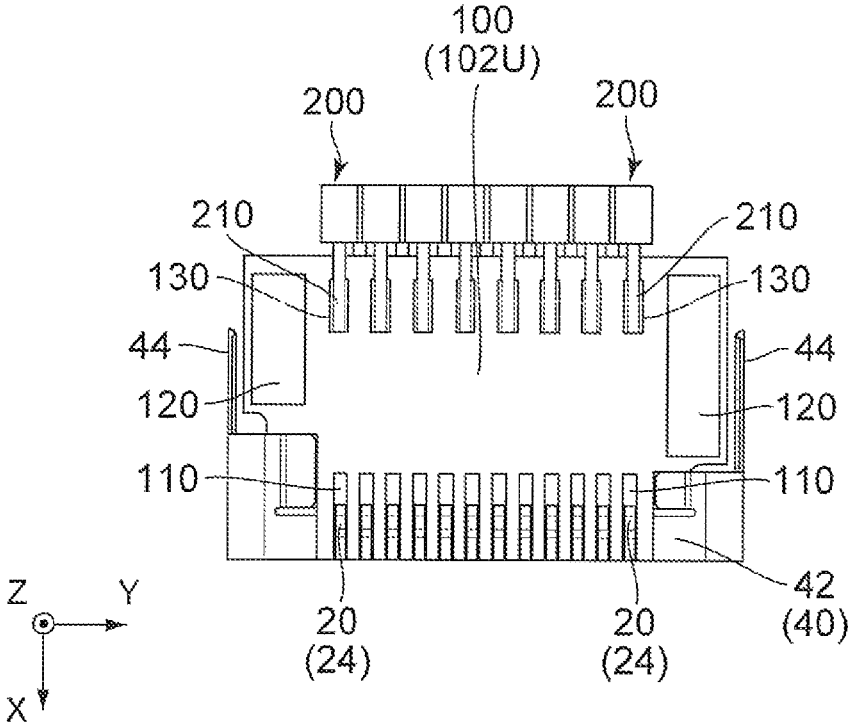
FIG. 13 is an enlarged, top view showing a part of the structural body of FIG. 8.
Figure 14:
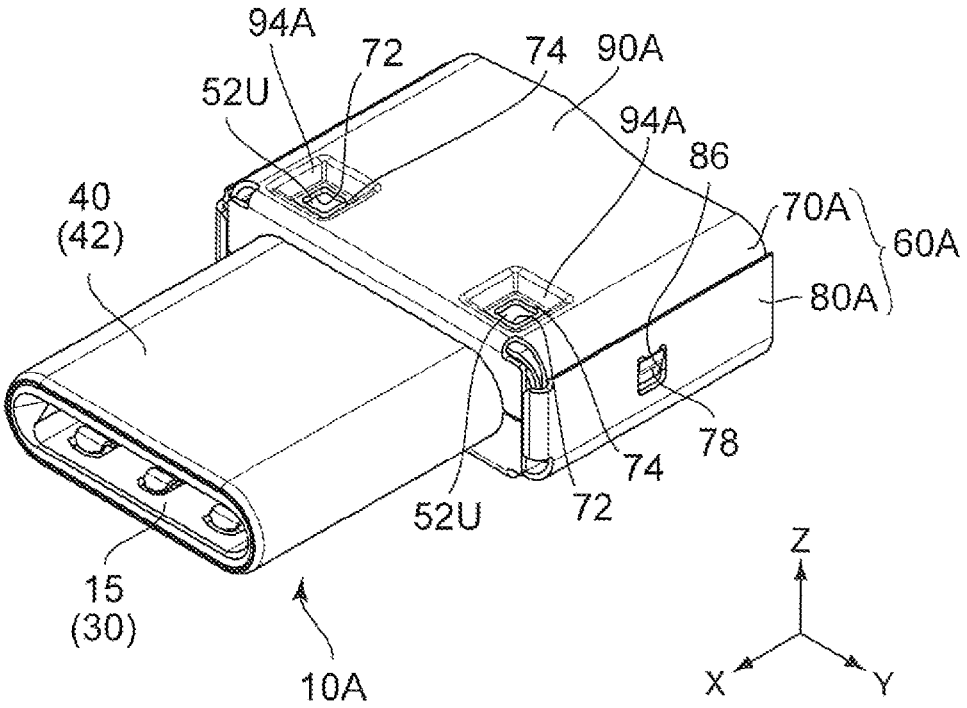
FIG. 14 is a top perspective view showing another connector different from the connector of FIG. 1 with regard to a back shell only.
Figure 15:
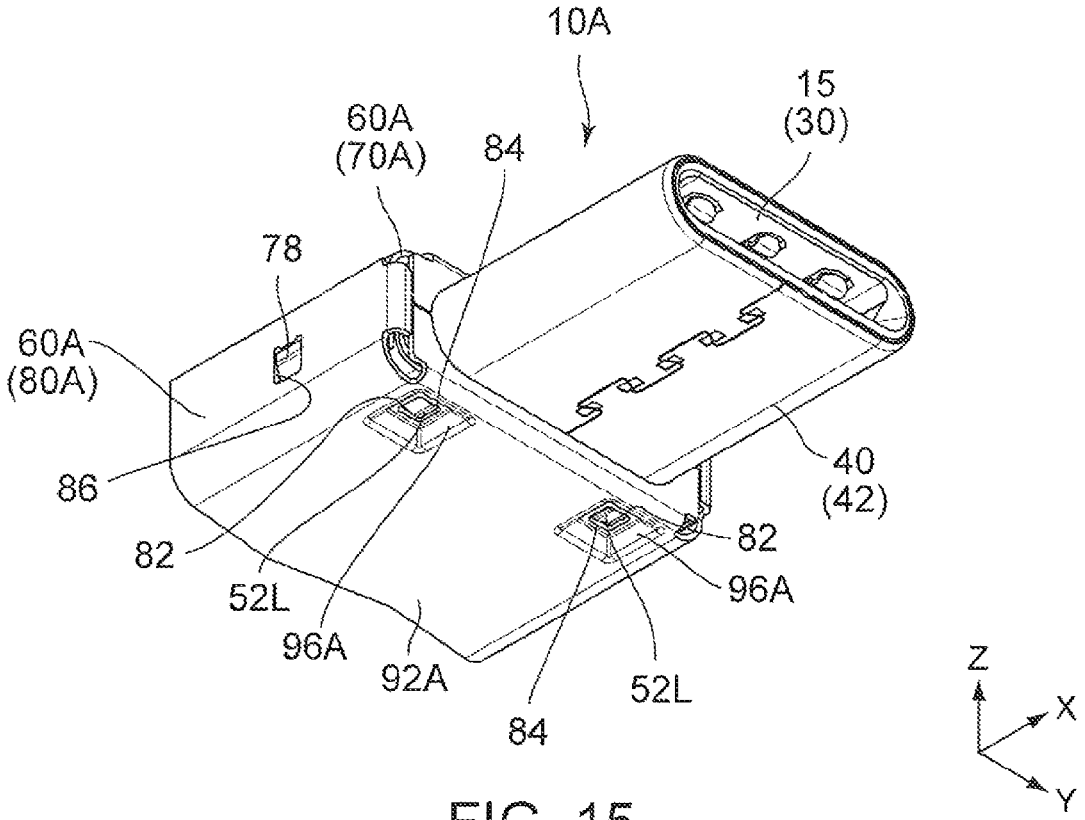
FIG. 15 is a bottom perspective view showing the connector of FIG. 14.
Figure 16:
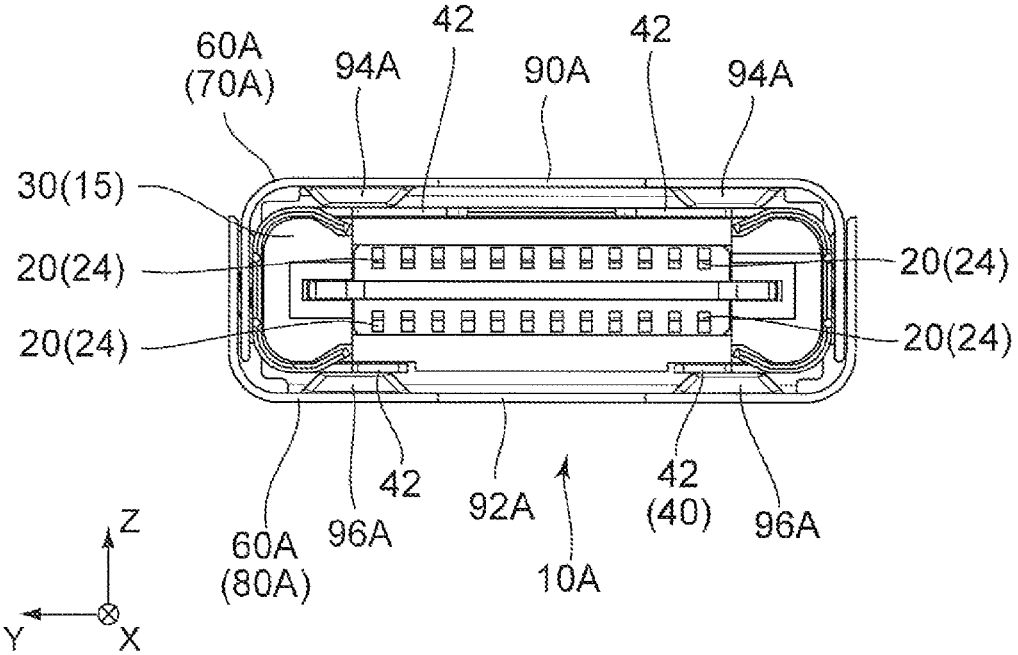
FIG. 16 is a rear view showing the connector of FIG. 14.
Figure 17:
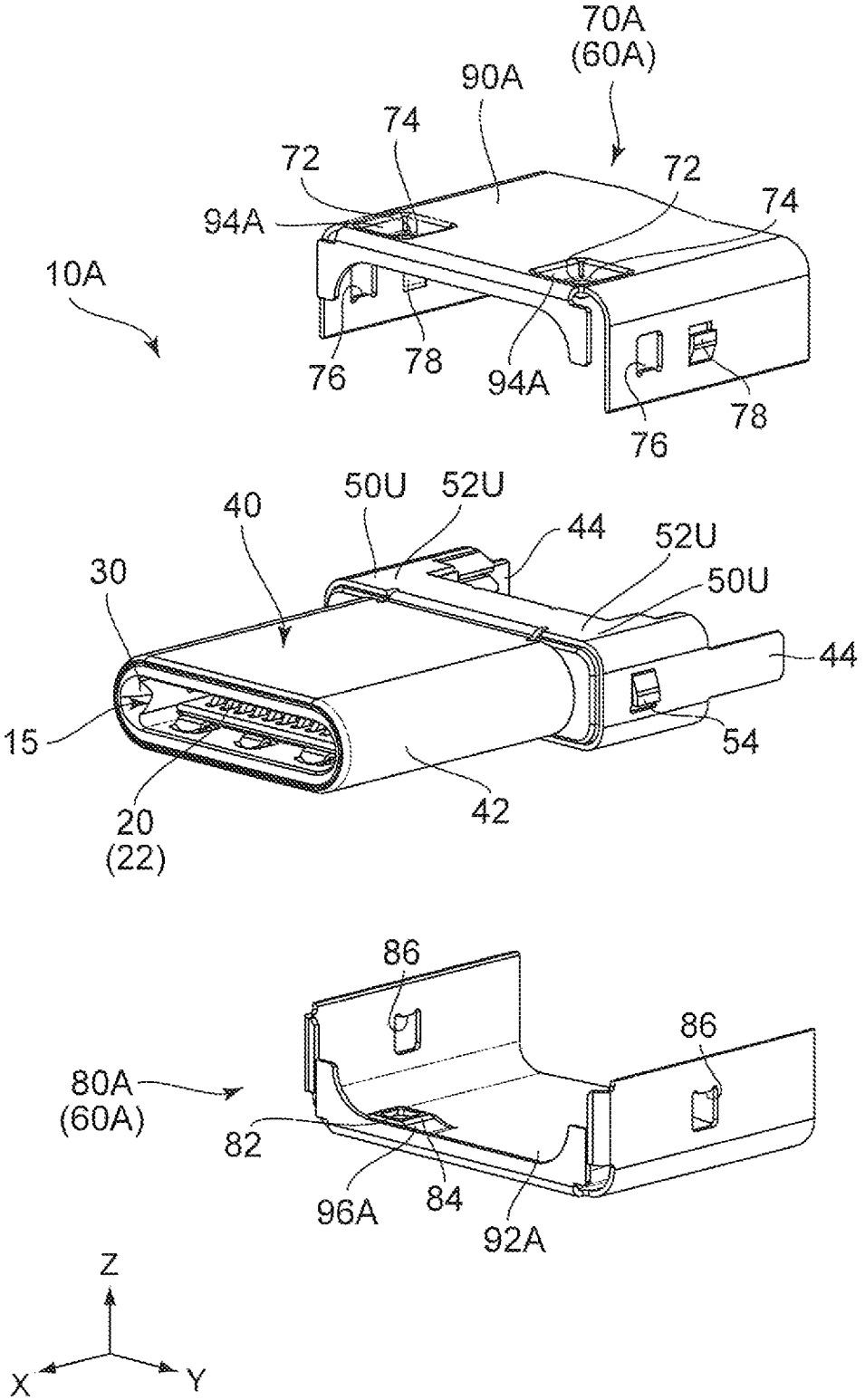
FIG. 17 is an exploded, top perspective view showing the connector of FIG. 14.
Figure 18:
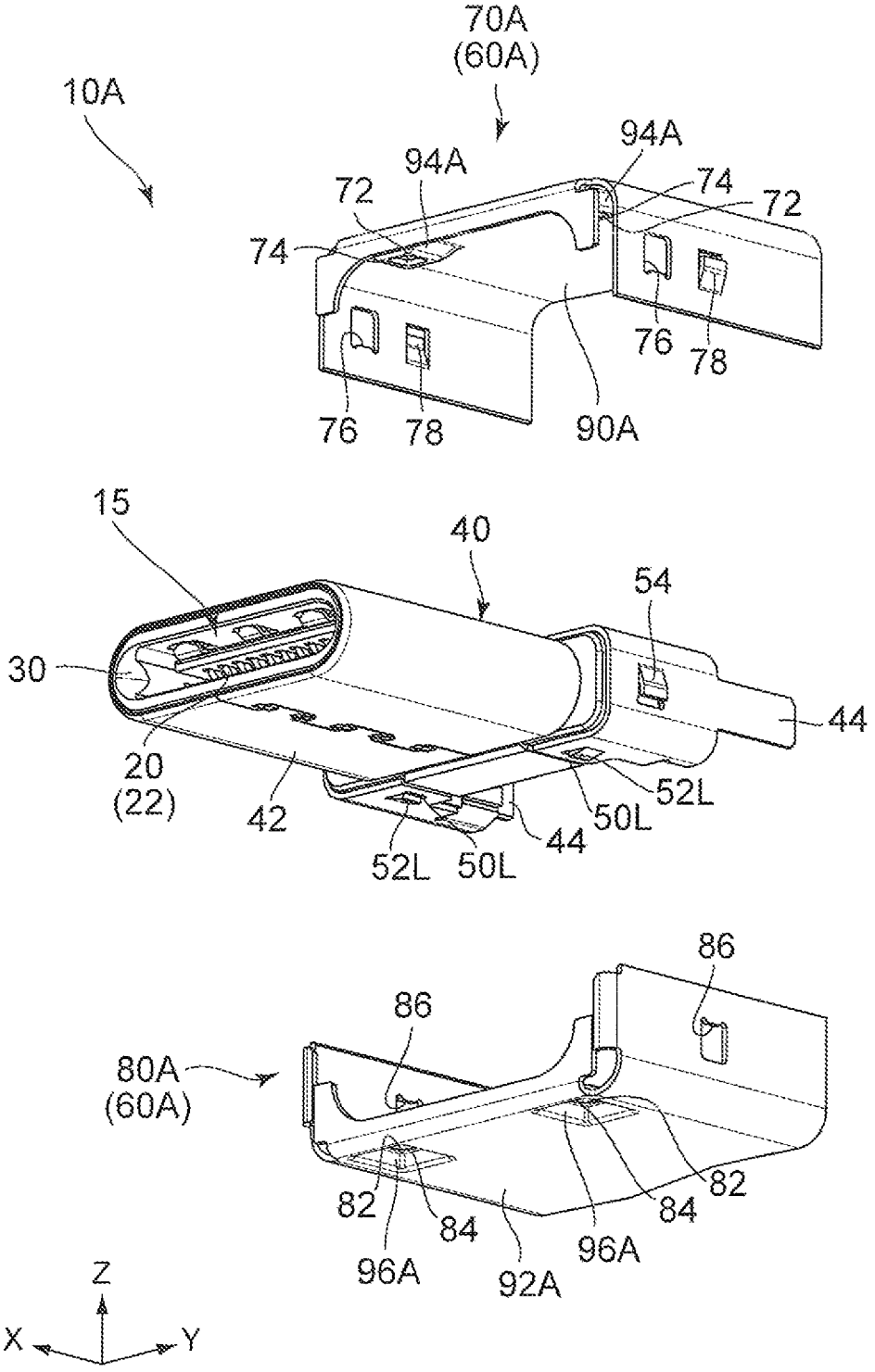
FIG. 18 is an exploded, bottom perspective view showing the connector of FIG. 14.
Figure 19:
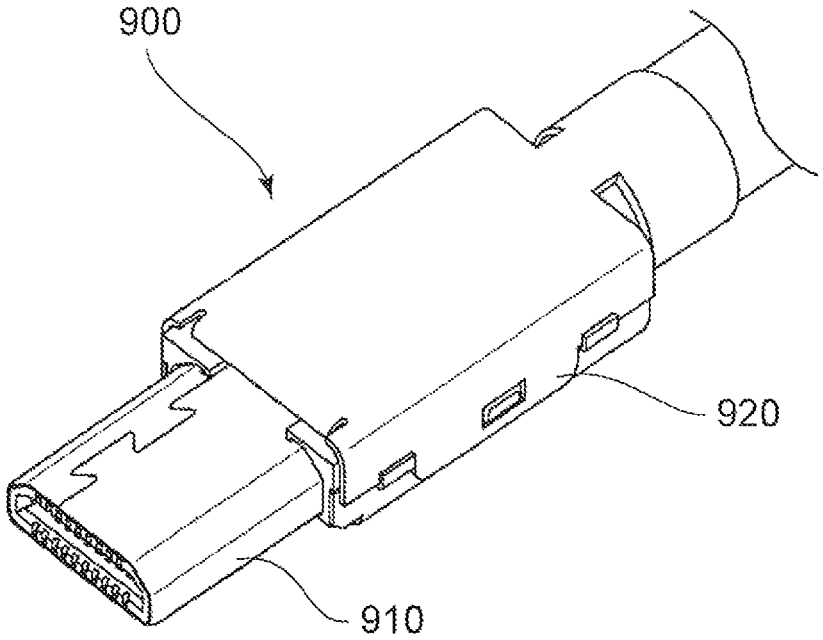
FIG. 19 is a perspective view showing a connector of Patent Document 1.
Figure 20:
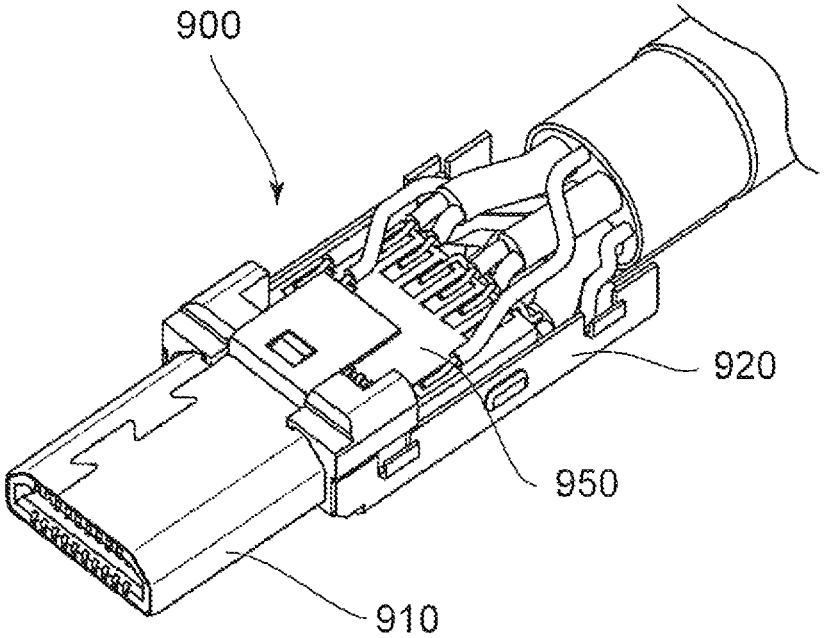
FIG. 20 is another perspective view showing the connector of Patent Document 1. A part of a back shell is detached, and a structure of inside of the back shell is visible.

As shown in FIGS. 6 and 7, the paddle card 100 has two main surfaces of an upper surface 102U and a lower surface 102L. The upper surface 102U and the lower surface 102L intersect with the orthogonal direction. On the upper surface 102U of the paddle card 100, a plurality of first pads 110, two second pads 120 and a plurality of third pads 130 are formed. Similarly, on the lower surface 102L of the paddle card 100, a plurality of first pads 110, two second pads 120 and a plurality of third pads 130 are formed.

As understood from FIGS. 8 to 13, the first pads 110 are parts to be connected to the connection portions 24 of the contacts 20 by means of solder. The second pads 120 are parts to be fixed to the protruding portions 44 of the front shell 40 by means of solder. The third pads 130 are parts to be connected to core wires 210 of cables 200 by means of solder. The second pads 120 are located rearward of the first pads 110 in the front-rear direction and located apart from the first pads 110 in the lateral direction. In other words, the first pads 110 are located between the second pads 120 in the lateral direction. The third pads 130 are located rearward of the second pads 120 at least in part in the front-rear direction and located inward of the second pads 120 in the lateral direction. That is, the third pads 130 are located between the second pads 120 in the lateral direction.

As understood from the aforementioned description, in the present embodiment, the paddle card 100 is provided with four of the second pads 120 in total. One pair of one of the second pads 120 on the upper surface 102U and one of the second pads 120 on the lower surface 102L corresponds to one of the protruding portions 44. Each of the protruding portions 44 is juxtaposed, in the lateral direction, with two of the second pads 120 forming the pair corresponding thereto. The protruding portions 44 have a size larger than a thickness (a size in the Z-direction) of the paddle card 100 in the up-down direction. The protruding portions 44 protrude both upward and downward of the paddle card 100. Each of the protruding portions 44 extends in the X-Z plane while each of the second pads 120 extends in the X-Y plane. That is, the planes in which the protruding portions 44 extend and the planes in which the second pads 120 extend intersect with each other. Each of the protruding portions 44 is fixed to two of the second pads 120 forming the pair corresponding thereto by means of solder.

In an assembly process of the connector 10, there is a case where a force is applied to the paddle card 100 by swing of the cables 200 or the like. Even in such a case, since the second pads 120 are physically connected and fixed to the protruding portions 44 of the front shell 40 by means of solder, it can be reduced to concentrate a load on connection portions between the connection portions 24 of the contacts 20 and the first pads 110.

In addition, connection between the second pads 120 and the protruding portions 44 can be performed in a process same as a connection process for connecting the connection portions 24 of the contacts 20 to the first pad 110 or a connection process for connecting the core wires 210 of the cables 200 to the third pads 130. Accordingly, it is unnecessary to perform a process purely for connecting between the second pads 120 and the protruding portions 44 specially, and manufacturing cost does not increase significantly.

As understood from FIGS. 3 to 5, the back shell 60 is attached to a rear portion of the front shell 40 as follows. At first, the upper member 70 of the back shell 60 is laid over a rear part of the front shell 40 from above, so that the side protruding portions 54 of the front shell 40 are fitted into the side opening portions 76 of the upper member 70. After that, the lower member 80 of the back shell 60 is laid over the rear part of the front shell 40 from beneath so that the side protruding portions 78 of the upper member 70 are fitted into the side opening portions 86 of the lower member 80. In this manner, the back shell 60 is attached to the rear portion of the front shell 40.

As best shown in FIG. 5, in the predetermined direction, the second contact portions 74 are in contact with the first contact portions 50U while the second contact portions 84 are in contact with the first contact portions 50L. Especially, in the present embodiment, the second contact portions 74 are in surface contact with the first contact portions 50U while the second contact portions 84 are in surface contact with the first contact portions 50L. Thus, positioning of the upper member 70 of the back shell 80 with respect to the front shell 40 is performed while positioning of the lower member 80 of the back shell 60 with respect to the front shell 40 is performed.

In the predetermined direction, the fixed portions 52U overlap with the opening portions 72 while the fixed portions 52L overlap with the opening portions 82. Furthermore, the lower fixed portions 52L are located inside the opening portions 82 in the orthogonal plane. That is, the fixed portions 52L protrude into the opening portions 82. By fixing the fixed portions 52U and the second contact portions 74 to each other using solder through the opening portions 72 and fixing the fixed portions 52L and the second contact portions 84 to each other using solder through the opening portions 82, the back shell 60 can be connected to the front shell 40. In particular, regarding the lower member 80 of the back shell 60 and the front shell 40, since the fixed portions 52L protrude into the opening portions 82, a distance from the fixed portions 52L to lower surfaces of the second contact portions 84 can be shortened. Therefore, according to the present embodiment, it is easy to connect the fixed portions 52L and the second contact portions 84 to each other by means of solder.

In this manner, by bringing the first contact portions 50U and 50L into contact with the second contact portions 74 and 84 and fixing the fixed portion 52U and 52L to the second contact portions 74 and 84 by means of solder through the opening portions 72 and 82, posture of the back shell 60 can be stabilized.

Referring to FIGS. 14 to 18, a connector 10A has a back shell 60A. The back shell 60A of FIGS. 14 to 18 has a size which is larger, particularly in the predetermined direction, in comparison with that of the back shell 60 of FIGS. 1 to 4. As understood from comparing FIGS. 1 to 4 with FIGS. 14, 15, 17 and 18, the connector 10A is different from the aforementioned connector 10 with respect to the back shell 60A only and provided with those same as the connector body 15 and the front shell 40.

The back shell 60A has two main portions 90A and 92A which are plate-like and orthogonal to the predetermined direction. In detail, the back shell 60A has two members of an upper member 70A and a lower member 80A. The main portion 90A is provided in the upper member 70A while the main portion 92A is provided in the lower member 80A. The back shell 60A has a distance between the main portion 90A and the main portion 92A, and the distance is larger in comparison with a case of the aforementioned back shell 60 of FIGS. 1 and 2. That is, the back shell 60A has a size different from that of the back shell 60 of FIGS. 1 and 2 in the predetermined direction. In order to deal with this size change, the back shell 60A is provided with coupling portions 94A and 96A.

In detail, the upper member 70A of the back shell 60A has the main portion 90A and the coupling portions 94A. The main portion 90A is located apart from the opening portions 72 and the second contact portions 74 in the predetermined direction. The coupling portions 94A couple the second contact portions 74 and the main portion 90A to each other. The lower member 80A of the back shell 60A has the main portion 92A and the coupling portions 96A. The main portion 92A is located apart from the opening portions 82 and the second contact portions 84. The coupling portions 96A couple the second contact portions 84 and the main portion 92A to each other.

In particular, the coupling portions 94A and 96A according to the present embodiment have a cylindrical shape with a cross section of a trapezoidal shape in a plane including the predetermined direction (e.g. a plane such as the X-Y plane or the Y-Z plane). To be more specific, the coupling portions 94A and 96A of the present embodiment have the cylindrical shape with side surfaces of the trapezoidal shape. Even if a size of the back shell 60A is changed in the predetermined direction, relative positional relationship of the first contact portions 50U and 50L with respect to the second contact portions 74 and 84 can be adjusted in a state same as that in the case of the back shell 60 of FIGS. 1 and 2 by changing a height (a size in the Z-direction) of the coupling portions 94A and 96A. Moreover, by bringing the first contact portions 50U and 50L into contact with the second contact portions 74 and 84 and fixing the fixed portions 52U and 52L to the second contact portions 74 and 84 by means of solder through the opening portions 72 and 82, posture of the back shell 60 can be stabilized.

Although the specific explanation about the present invention is made above, the present invention is not limited thereto but susceptible to various modifications.

Although the solder is used to connect the front shell 40 and the back shell 60 or 60A to each other in the aforementioned embodiments, the present invention is not limited thereto but another conductive fixing agent may be used in place of the solder.

Although the first contact portions 50U and the fixed portions 52U are formed as the parts of the same plate-like portion in the aforementioned embodiments, the fixed portions 52U may protrude upward of the first contact portions 50U. Moreover, although the fixed portions 52L protrude downward of the first contact portions 50L in the aforementioned embodiments, the first contact portions 50L and the fixed portions 52L may be formed as parts of one and the same plate-like portion.

Although the second pads 120 are formed on the upper surface 102U and the lower surface 102L of the paddle card 100 in the aforementioned embodiments, they may be formed on side surfaces (edges orthogonal to the lateral direction) of the paddle card 100, for example.

The present application is based on a Japanese patent application of JP2014-115217 filed before the Japan Patent Office on Jun. 3, 2014, the content of which is incorporated herein by reference.

While there has been described what is believed to be the preferred embodiment of the invention, those skilled in the art will recognize that other and further modifications may be made thereto without departing from the spirit of the is invention, and it is intended to claim all such embodiments that fall within the true scope of the invention.

REFERENCE SIGNS LIST

10, 10A Connector
15 Connector Body
20 Contact
22 Contact Point Portion
24 Connection Portion
30 Holding Portion
40 Front Shell (Shell)
42 Main Portion
44 Protruding Portion
50U, 50L First Contact Portion
52U, 52L Fixed Portion
54 Side Protruding Portion
60, 60A Back Shell
70, 70A Upper Member
72 Opening Portion
74 Second Contact Portion
76 Side Opening Portion
78 Side Protruding Portion
80, 80A Lower Member
82 Opening Portion
84 Second Contact Portion
86 Side Opening Portion
90A, 92A Main Portion
94A, 96A Coupling Portion
100 Paddle Card (Relay Board)
102U Upper Surface (Main Surface)
102L Lower Surface (Main Surface)
110 First Pad
120 Second Pad
130 Third Pad
200 Cable
210 Core Wire

The invention claimed is:

1. A shielding connector mateable with a mating connector in a front-rear direction, wherein:

the connector comprises a front shell and a back shell; the back shell overlaps with the front shell in a predetermined direction orthogonal to the front-rear direction;

the front shell is provided with a first contact portion and a fixed portion;

the first contact portion surrounds a periphery of the fixed portion in a plane orthogonal to the predetermined direction;

the back shell is provided with an opening portion and a second contact portion;

the second contact portion surrounds a periphery of the opening portion in a plane orthogonal to the predetermined direction;

the second contact portion is in contact with the first contact portion in the predetermined direction so that the fixed portion is visible within the opening portion in the predetermined direction and that the back shell is positioned with respect to the front shell; and the fixed portion and the second contact portion are fixable to each other using a conductive fixing agent through the opening portion.

2. The shielding connector as recited in claim 1, wherein the fixed portion is more protrusive than the first contact portion in the predetermined direction and located inside the opening portion in a plane orthogonal to the predetermined direction.

3. The shielding connector as recited in claim 1, wherein the second contact portion is in surface contact with the first contact portion.

4. The shielding connector as recited in claim 1, wherein the conductive fixing agent is solder.

5. The shielding connector as recited in claim 1, wherein the back shell has a main portion and a coupling portion; the main portion of the back shell, is located apart from the second contact portion in the predetermined direction; and the coupling portion of the back shell couples the main portion of the back shell and the second contact portion to each other.

6. The shielding connector as recited in claim 5, wherein the coupling portion has a cylindrical shape with a sectional shape of a trapezoid in a plane including the predetermined direction.

7. The shielding connector as recited in claim 1, wherein the connector comprises a connector body and a paddle card; the connector body includes a contact;

the front shell has a main portion and a protruding portion; the main portion of the front shell covers the connector body at least in part;

the protruding portion of the front shell protrudes rearward from the main portion of the front shell in the front-rear direction;

the paddle card protrudes rearward from the main portion of the front shell in the front-rear direction;

the paddle card is formed with a first pad and a second pad; the first pad is to be connected to the contact; the second pad is located rearward of the first pad in the front-rear direction and located apart from the first pad in a lateral direction orthogonal to both of the front-rear direction and an orthogonal direction orthogonal to the front-rear direction;

the protruding portion of the front shell has a size larger than a thickness of the paddle card in the orthogonal direction and is juxtaposed with the second pad in the lateral direction;

the protruding portion of the front shell and the second pad of the paddle card are fixable to each other using the conductive fixing agent.

8. The shielding connector as recited in claim 7, wherein the protrusion portion has a flat-plate shape.

9. The shielding connector as recited in claim 7, wherein the paddle card is further provided with a third pad to be connected to a connection object; and the third pad is located rearward of the protruding portion at least in part in the front-rear direction and located inward of the second pad in the lateral direction.

10. The shielding connector as recited in claim 7, wherein the paddle card has a main surface intersecting the orthogonal direction; and the first pad and the second pad are formed on the main surface of the paddle card.

11. The shielding connector as recited in claim 10, wherein the paddle card has two of the main surfaces;

each of the main surfaces is provided with two of the second pads which are located apart from each other in the lateral direction;

the front shell has two of the protruding portions; and each of the protruding portions protrudes out from both outsides of the paddle card in the orthogonal direction and fixed to one of the second pads formed on one of the main surfaces and to one of the second pads formed on the other of the main surfaces.

* * * * *